US007234518B2

(12) United States Patent
Smith

(10) Patent No.: US 7,234,518 B2
(45) Date of Patent: Jun. 26, 2007

(54) ADJUSTABLE WELL SCREEN ASSEMBLY

(75) Inventor: David Randolph Smith, Kilgore, TX (US)

(73) Assignee: Shell Oil Company, Houston, TX (US)

( * ) Notice: Subject to any disclaimer, the term of this patent is extended or adjusted under 35 U.S.C. 154(b) by 241 days.

(21) Appl. No.: 10/488,822

(22) PCT Filed: Sep. 4, 2002

(86) PCT No.: PCT/EP02/10052

§ 371 (c)(1),
(2), (4) Date: Aug. 16, 2004

(87) PCT Pub. No.: WO03/023185

PCT Pub. Date: Mar. 20, 2003

(65) Prior Publication Data

US 2004/0251020 A1 Dec. 16, 2004

(51) Int. Cl.
*E21B 43/00* (2006.01)

(52) U.S. Cl. ..... 166/227; 166/320

(58) Field of Classification Search ..... 166/227, 166/320, 321

See application file for complete search history.

(56) References Cited

U.S. PATENT DOCUMENTS

| | | | | |
|---|---|---|---|---|
| 3,993,130 | A | 11/1976 | Papp | 166/330 |
| 4,691,778 | A | 9/1987 | Pyne | 166/320 |
| 5,111,883 | A | 5/1992 | Savery | 166/269 |
| 5,447,201 | A | 9/1995 | Mohn | 166/375 |
| 5,922,975 | A * | 7/1999 | Butler et al. | 73/864.74 |
| 6,112,815 | A | 9/2000 | Boe et al. | 166/320 |
| 6,220,357 | B1 | 4/2001 | Carmichael et al. | 166/321 |
| 6,543,544 | B2 * | 4/2003 | Schultz et al. | 166/373 |

FOREIGN PATENT DOCUMENTS

| | | |
|---|---|---|
| FR | 2543213 | 9/1984 |
| GB | 2325949 | 12/1998 |
| GB | 2369382 | 5/2002 |
| WO | 01/29368 | 4/2001 |
| WO | 02/06593 | 1/2002 |

* cited by examiner

*Primary Examiner*—William P Neuder
(74) *Attorney, Agent, or Firm*—Rachael Stiegel

(57) ABSTRACT

An adjustable well screen assembly having a sand screen which is wrapped around a perforated base pipe and a perforated sleeve which is movably disposed concentrically inside the base pipe between a first, closed, and a second, open, position. In the first position of the sleeve the perforations of the sleeve and base pipe are unaligned and hydraulically isolated from each other and flow of fluids from the outer diameter of the screen into the interior of the sleeve is inhibited. In the second position the perforations of the sleeve and the base pipe are aligned and connected in fluid communication with each other and fluids are permitted to flow from the formation through the sand screen and the perforations of the sleeve and base pipe into the interior of the sleeve.

7 Claims, 1 Drawing Sheet

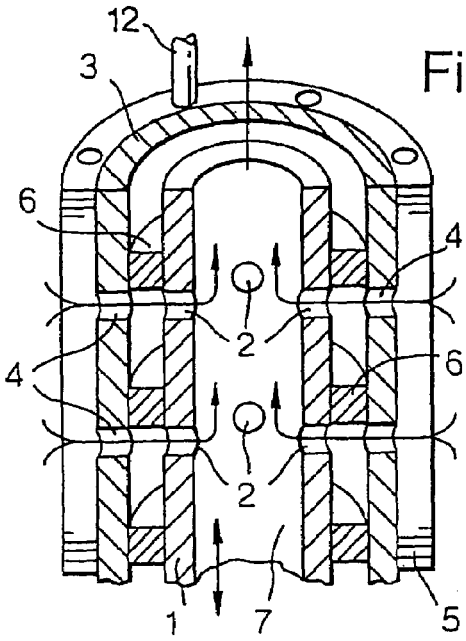
Fig.1.
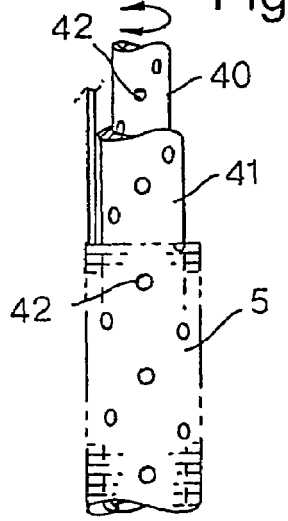
Fig.4.
Fig.2.
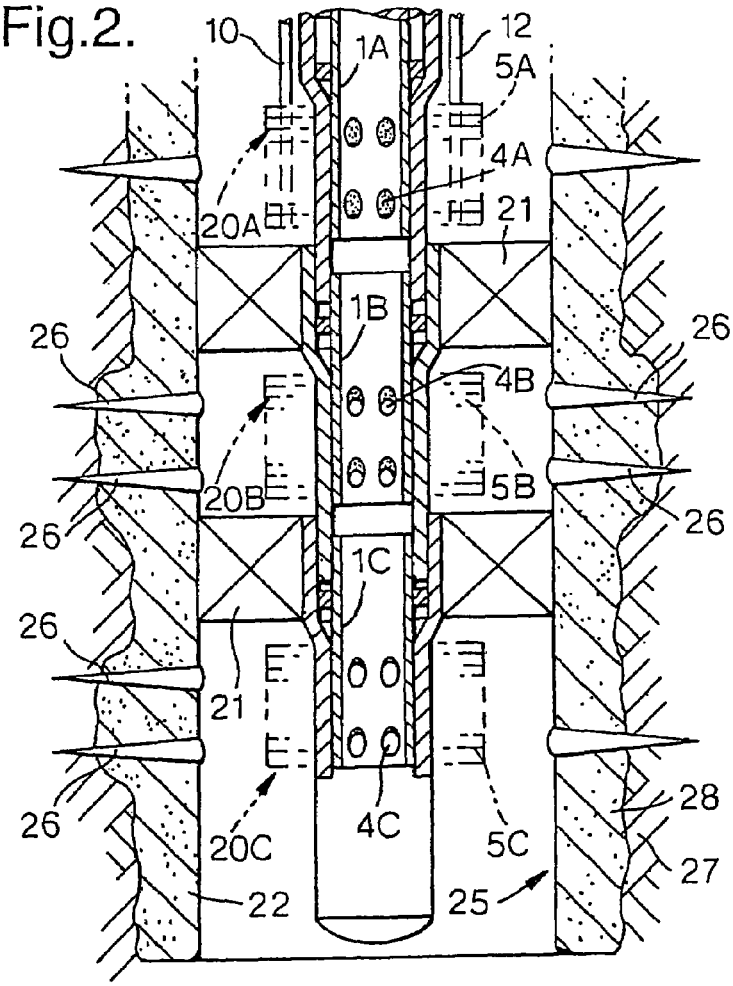
Fig.3.
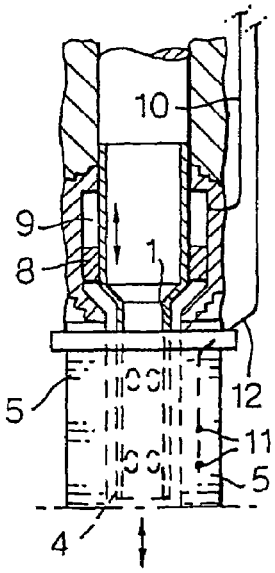

ADJUSTABLE WELL SCREEN ASSEMBLY

FIELD OF INVENTION

This invention relates to an adjustable well screen assembly for controlled inflow of fluids from a hydrocarbon fluid containing formation into the production tubing of a hydrocarbon fluid production well. The invention also relates to a hydrocarbon fluid production well, which is equipped with one or more adjustable well screen assemblies.

BACKGROUND OF INVENTION

The art of completing wells to exclude solids particles produced by well fluids is commonly known in the literature as gravel packing.

It is common practice in the construction of wells bored into the earth to dispose steel casing or other tubular conduits inside of the well. In some well constructions the casing is grouted into the bore by placing portland cement in the annular space between the casing and the well bore. The casing can be deployed through the depth where the productive subterranean formation or plurality of formations is encountered below the surface. In the former the well completion is referred to those familiar with the art of well completions as open hole completions, whereas those well completions where the casing and cement is run through or past the depth of the productive formation is known to those familiar with the art of well completions as cased holes. In either case of open hole completions or cased hole completions it is well practised art to dispose across the production formation depths sand screens, slotted pipes, or pipes with holes pre-perforated at surface into the well casing on a second continuous tube known in the literature as production tubing.

Production tubing is disposed inside of the casing extending from the surface to a depth closer to the production formation. It is often desirable to place a packer on the end of the production tubing to force well fluids up the tubing and avoid fluids being produced up the casing. The production tubing is then a removable pipe that is disposed in wells generally in jointed lengths of 40 feet (about 12 m), but can be deployed as a continuous tubing string in what is commonly known in the oil and gas industry as continuous tubing. It is common practice to deploy in production tubing string various apparatus to allow for well fluid control. It is also common to control such devices from surface using electrical and hydraulic tubes disposed simultaneously with the production tubing and connected to the outer diameter of the production tubing. These hydraulic tubes are known to those familiars with the art of well completions as control lines.

In the cased hole completions it is common practice to run explosive charges into the well after the casing is cemented across the productive formation depths and perforate holes through the casing and cement into the productive formation to create a path for fluid flow into the well.

In many wells either in cased or open hole completions unwanted formation solids are produced into the well along with the production fluids. These solids are often undesirable and many methods of stopping these solids from flowing into the well whilst producing the fluids are well defined in the literature as the art sand control. One of the more familiar methods of stopping solid flow is to perform a gravel pack.

A gravel pack is performed by placing a known size of sand, which is referred to as the gravel, into the well across the production formation to create a filter medium to stop or reduce the flow of solid materials from the formation into the well. The gravel is most commonly prohibited from flowing into the well by a device commonly know as a well screen. The well screens are designed to keep the specialized sand mesh, known as the gravel, in place in the annular space between the casing or well bore outside of the screens forming the filter media.

The current methods of placing a gravel pack is requires that the screens be deployed in the well on a tubing string from surface until the screens are at the depth of the producing formation. At this point sand is placed around the screens by various methods of pumping, circulating, and other wise dispose sand around the screens. Once the sand is placed around the screens the tubing string is detached from the screens and extracted from the well. Thereafter the production tubing with packers, control lines, sliding sleeves, and packers are disposed in the well above the screens. Hence the screens are detached from the production string in the common known methods of the industry.

It is current practice to build the well screens out of wire wrap welded to bars running parallel to the screen axis and said bars are placed around a pipe extending the length of the screen with holes through the pipe. This pipe is commonly known to those familiars with the art as the base pipe and forms the structure to which the wire wrap and welded bars are attached. Hence the commonly known well screen consists of wire wrap helically wrapped around the circumference of the screen attached to welded bars that are fitted onto the outer diameter of base pipe. In other designs of sand screens the screen is manufactured with sintered materials located between the wire wrap or in some cases outside of the wire wrap. In all cases the screen has an inner pipe base that holes or other geometric penetrations to allow fluids to flow into the screens inner diameter.

The well screen lengths disposed in wells vary in length to accommodate the depth and heights of production zones. To accommodate deployment of screens they are run in sections and connected on surface to match the height of the production zones.

In many wells there exists in one common well bore multiple production formations that are perforated or otherwise left open hole to allow simultaneous production from several formations at varying depths into the well bore and up the production casing. Often in these multiple production formations wells the different formations in the earth are separated by lithology that does not have productive fluids often times due to lower permeability and porosity. With the current art these varying production formations are completed simultaneously and flow into a common production tubing to surface. It often occurs that one productive formation will produce less fluids, or unwanted fluids, or for resource management reasons the varying formations may be more desirably produced at different flow rates or be produced at different times. In the case of gravel packed wells the methods to shut of production from a formation in a well with multiple production formations producing simultaneously into a common well bore requires mechanical well intervention techniques none to those familiar to the art. These intervention techniques can include, squeeze cementing, the setting of plugs via wireline and rig methods, and the pulling of production tubing, control lines, electrical cable, packers, sleeves and other disposed subterranean devices in the well. The above prior art techniques require mechanical intervention into the well with pipes, wireline, or pumped chemicals into the well bore to affect the inflow of fluids into and through screen systems.

U.S. Pat. No. 5,447,201 discloses an adjustable fluid inflow assembly for an oil or gas well where the influx of fluids from a plurality of annular inflow zones is controlled by a series of annular disk shaped valves which are each arranged between a downstream end of each inflow zone and a production tubing passing therethrough.

A disadvantage of the known assembly is that all fluid entering an annular inflow zone needs to be discharged through an annular disk shaped valve and the fluid flow rate in each valve is therefore high which causes a high rate of wear of the valve. The current invention aims to alleviate this and other disadvantages of the known well inflow control assembly such that production formations can be shut off or their fluid production reduced from production zones by non-intervention methods from surface.

SUMMARY OF THE INVENTION

The adjustable well screen assembly according to the invention thereto comprises a sandscreen which is arranged around a perforated base pipe and a perforated sleeve which is arranged concentrically relative to the base pipe and is movable relative to the base pipe between a first and a second position. In said first position of the sleeve the perforations of the sleeve and base pipe are hydraulically isolated from each other and flow of fluids from the outer diameter of the screen into the interior of the sleeve is inhibited. In said second position the perforations of the sleeve and the base pipe are connected in fluid communication with each other and fluids are permitted to flow from the formation through the sandscreen and the perforations of the sleeve and base pipe into the interior of the sleeve.

Preferably, the sleeve is arranged within the base pipe and the outer diameter of the sleeve is slightly smaller than the inner diameter of the base pipe and the sleeve is connected to an actuator, such as a hydraulic or electrical motor, which is designed to rotate and/or axially translate the sleeve within the base pipe.

Optionally, the actuator is designed to rotate and/or translate the sleeve such that the sleeve is positionable in a range of intermediate positions between the first and second position, in which intermediate positions the perforations of the sleeve and base pipe form adjustable flow restrictions which can be gradually opened and closed.

The sandscreen may be equipped with one or more sensors for monitoring physical parameters such as the pressure, temperature, velocity and/or composition of the fluids flowing through the screen and the actuator is designed to move the sleeve between the first and second position thereof in response to signals generated by at least one of the sensors deployed in the screen system.

The invention also relates to a hydrocarbon fluid production well comprising a hydrocarbon fluid inflow zone which is equipped with a plurality of axially spaced adjustable well screen assemblies with perforated base pipes in which perforated sleeves are movably arranged wherein the perforated base pipes of adjacent adjustable well screen assemblies are interconnected by blank pipe sections on which an expandable packers is arranged which provides a fluid seal in the annular space between the outer surface of the blank pipe section and the inner surface of the wellbore.

In such case it is preferred that the sleeve of each adjustable well screen assembly is movable between the first and second position independently of position of the other sleeve or sleeves.

The present invention teaches an improved method of disposing well screens in to wells such that production formations fluid flows into the well can be controlled by subterranean devices disposed in the well attached to well screen systems of this invention.

Thus the present invention provides an apparatus to allow for well screen system to be disposed into well bores simultaneously with production tubing, and control tubes deployed continuously from surface to the sand screen system depths. Hence this invention teaches the use of continuous connection of tubes and or electrical cable from the surface to the production formations depths where the tubes are attached to sand screen systems prior to, during, and after the gravel pack operations such the tubes and screen system do not need to be disconnected from the surface deployed production tubing. One end of the control tube extends to surface to allow communication and power to be communicated to the subterranean depth where the sand screen system is disposed.

This invention apparatus then allows subterranean devices and sensors to be attached to sand screen systems such that data can be read and signals and power can be sent to the down hole system.

This invention allows for sand screen systems to reduce or shut off fluid flow, determine the flow characteristics and reservoir properties of down hole formations, and to isolate different production zones completed simultaneously in a common well bore.

BRIED DESCRIPTION OF THE DRAWING

FIG. 1 depicts a longitudinal sectional view of an adjustable well screen assembly according to the invention;

FIG. 2 depicts a schematic side view of an inflow zone of an oil and/or gas production well in which three adjustable well screen assemblies according to the present invention are arranged;

FIG. 3 depicts in more detail the upper end of one of the movable sleeves of FIGS. 1 and 2 and the actuator mechanism for axially translating the sleeve within the base pipe; and FIG. 4 depicts a schematic three dimensional view of an alternative arrangement of a well screen and perforated base pipe and sleeve assembly according to the invention.

DETAILED DESCRIPTION OF THE INVENTION

The adjustable screen assembly shown in FIG. 1 comprises an inner sleeve 1 having perforations 2 being disposed concentrically inside of a well screen's 5 inner diameter base pipe 3 having perforations 4 to allow fluid to flow from the sand screen 5 into the interior 7 of the inner sleeve 1. The inner sleeve 1 is axially slidable within the base pipe 3 such that appropriate sealing rings 6 can be moved between the second position shown in FIG. 1, in which well fluids are permitted to flow through the sandscreen 5 and the aligned perforations 4 and 2 of the base pipe 3 and inner sleeve 1 into the interior of the sleeve 1 and a first position (not shown) in which the sealing rings 6 close off the perforations 4 in the base pipe 3 such that the fluid flow from the sandscreen 5 into the interior of the sleeve 1 is inhibited or stopped. This axial movement of the inner sleeve 1 relative to the base pipe 3 may be initiated by a hydraulic piston and cylinder assembly 8,9 which is shown in FIG. 3. The hydraulic piston and cylinder assembly 8,9 may be connected to a hydraulic pump (not shown) at the earth surface by a hydraulic conduit 10.

The adjustable well screen assembly according to the invention may comprise any suitable combination of electrical power, hydraulic power, or optic powered apparatus that allow communication of power to, and transmission of data from, the assembly. In the embodiment shown in FIG. 3 the inner sleeve 1 is actuated from surface with hydraulic pressure supplied from surface through the hydraulic conduit 10. In this embodiment the hydraulic pressure would force the hydraulic piston 8 and associated perforated inner sleeve 1 to a new position in the perforated base pipe 3 changing the rate of flow through the well screen 5. Pressure, temperature, velocity, composition and/or other sensors 11 may be deployed in or around the sandscreen 5 to indicate the flow, fluid, and pressure changes resulting from the varying sleeve position and said sensors 11 transmit data to surface via one or more fibre optical and/or electrical signal transmission conduits 12 attached to the screen 5. It is also clear to any familiar to the art that said communication and power to the screen can be achieved by electrical optical, electromagnetic and or acoustic power and signal transmission methods. Hence the invention teaches the use of multiple power and communication methods to be used in the invention for both communication with the inventions sensors, and to power the subterranean devices of the invention.

FIG. 2 illustrates an embodiment of the invention comprising three adjustable screen assemblies 20A, 20B and 20C each with their own inner inner sleeve 1A, 1B and 1C connected to surface via simultaneously disposed power and signal transmission conduits 10 and 12. Hence this invention teaches the simultaneous disposal and use of multiple adjustable sand screen assemblies 20A, B and C such that one screen 20C can be opened whilst another 20A is substantially closed whilst another 20B is partly moved to reduce flow. It is clear to those familiar to the art of well production that said invention can be used to change inflow of several completed production formations without the current industry practice of well intervention.

In the embodiment shown in FIG. 2 a pair of packers 21 is arranged around blank sections of the production tubing 23 between the wire wraps 5A, 5B and 5C of three adjustable well screen assemblies 20A, 20B and 20C which are each similar to the well screen assembly shown in FIG. 1. These packers 21 form seals in the annular space between the inner surface of the well casing 22 and the production tubing 23 which carries the adjustable sand screen assemblies 20A, 20B and 20C. The packers 21 are connected to the production tubing 23. The packers 21 are inflated or set once the production tubing is at the proper depth in the well 25 adjacent to perforations 26 that have been shot through the well casing 22 and surrounding cement lining 28 into an oil and/or gas bearing formation 27 surrounding the well 25. Once the packers 21 and screen assemblies 20A–C are at the proper depth the packers 21 are set from surface using the various methods known to those familiar with the art such as hydraulic, electrical, and optical methods. Hence this invention teaches the simultaneous disposal via the production tubing 23 of adjustable sandscreen assemblies 20A–C and packers 21 attached thereto.

An additional embodiment of this invention (not shown) teaches the simultaneous production-tubing disposal of additional tubes and subterranean devices with the screen system on the production tubing. These devices can include down hole safety valves, down hole chokes, down hole valves and other devices discussed in the literature such that said devices are disposed simultaneously with the well screen system deployed on the production tubing.

FIG. 4 shows yet another embodiment of an adjustable well screen assembly according to the invention. In the embodiment shown in FIG. 4 a perforated inner sleeve 40 is rotatably arranged within a perforated base pipe 41 such that the perforations are unaligned in one position of the sleeve and become aligned when the sleeve is rotated within the base pipe 41. The inner sleeve 40 closely fits within the base pipe 41 and the contact surfaces may be equipped with a low friction coating to reduce the torque required to rotate the sleeve 40 relative to the base pipe. The patterns of the perforations 42 in the sleeve 40 and base pipe 41 may be slightly offset so that when the sleeve 40 is in its second position the perforations at the downstream end of the screen assembly are already slightly offset and that when the sleeve 40 is rotated towards its first position the perforations at the downstream end are closed off earlier than the perforations 42 at the upstream end of the adjustable well screen. The perforations 42 may be circular or have another shape to modify the level of fluid influx into the interior of the sleeve 40 between the upstream and downstream ends of the sleeve 40 as a result of incremental rotation of the sleeve from its first, closed, position towards its second, open, position and vice versa.

While the illustrative embodiments of the invention have been described with particularity, it will be understood that various other modifications will be readily apparent to, and can be easily made by one skilled in the art without departing from the spirit of the invention Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. An adjustable well screen assembly comprising; a sand screen which is arranged around a perforated base pipe; and a perforated sleeve which is movably disposed concentrically relative to the base pipe between a first and a second position, wherein in said first position of the sleeve, the perforations of the sleeve, and base pipe hydraulically isolates from each other and flow of fluids from the outer diameter of the screen into the interior of the sleeve is inhibited, and in said second position the perforations of the sleeve and the base pipe are connected in fluid communication with each other, and fluids are permitted to flow from the formation through the sand screen and the perforations of the sleeve and base pipe into the interior of the sleeve and wherein the outer diameter of the sleeve is slightly smaller than the inner diameter of the base pipe and the sleeve is connected to an actuator, which is designed to rotate and/or axially translate the sleeve within the base pipe; wherein the well screen is equipped with one or more sensors for monitoring physical parameters such as the velocity and/or composition of the fluids flowing through the screen, and the actuator is designed to move the sleeve between the first and second position thereof in response to signals generated by at least one of the sensors deployed in the screen system.

2. The well screen assembly of claim 1, wherein the actuator is designed to rotate or translate the sleeve such that the sleeve is positionable in a range of intermediate positions between the first and second position, in which in the intermediate positions the perforations of the sleeve and base pipe are partially aligned and form adjustable flow restrictions.

3. The well screen assembly of claim 1, wherein the actuator is a hydraulic actuator.

4. The well screen assembly of claim 1,wherein the sleeve is rotatably arranged within the base pipe.

5. A hydrocarbon fluid production well comprising a hydrocarbon fluid inflow zone which is equipped with a plurality of axially spaced adjustable well screen assemblies of claim 1 wherein the perforated base pipes of adjacent adjustable well screen assemblies are interconnected by blank pipe sections on which an expandable packer is arranged which provides a fluid seal in the annular space between the outer surface of the blank pipe section and the inner surface of the wellbore.

6. The hydrocarbon fluid production well of claim 5, wherein the sleeve of each adjustable well screen assembly is movable between the first and second position independently of position of the other sleeve or sleeves.

7. The well screen assembly of claim 1, wherein the actuator is a electrical motor.

* * * * *